US008326182B2

(12) United States Patent
Lehmann

(10) Patent No.: US 8,326,182 B2
(45) Date of Patent: Dec. 4, 2012

(54) PRINTING MACHINE AND PRINTING METHOD THEREFOR

(75) Inventor: Udo Lehmann, Bickenbach (DE)

(73) Assignees: Aurentum Innovationstechnologien GmbH, Mainz (DE); BASF SE, Ludwigshafen (DE)

( * ) Notice: Subject to any disclaimer, the term of this patent is extended or adjusted under 35 U.S.C. 154(b) by 293 days.

(21) Appl. No.: 12/451,470

(22) PCT Filed: May 27, 2008

(86) PCT No.: PCT/EP2008/056512

§ 371 (c)(1),
(2), (4) Date: Apr. 19, 2010

(87) PCT Pub. No.: WO2008/151932

PCT Pub. Date: Dec. 18, 2008

(65) Prior Publication Data

US 2010/0202804 A1 Aug. 12, 2010

(30) Foreign Application Priority Data

Jun. 11, 2007 (DE) ..... 10 2007 026 883

(51) Int. Cl.
*G03G 15/10* (2006.01)

(52) U.S. Cl. ..... 399/237; 399/233; 399/249

(58) Field of Classification Search ..... 399/222, 399/233, 237, 249
See application file for complete search history.

(56) References Cited

U.S. PATENT DOCUMENTS

| | | | |
|---|---|---|---|
| 4,332,196 | A | 6/1982 | Braun |
| 6,694,112 | B2 * | 2/2004 | Sasaki et al. |
| 2005/0158082 | A1 * | 7/2005 | Shin et al. |
| 2008/0063432 | A1 * | 3/2008 | Hattori et al. |

FOREIGN PATENT DOCUMENTS

| | | | |
|---|---|---|---|
| DE | 19544099 | A1 | 5/1997 |
| DE | 19718906 | A1 | 9/1999 |
| DE | 19957453 | C1 | 2/2001 |
| DE | 10106415 | A1 | 8/2002 |
| EP | 1987956 | A2 | 11/2008 |
| WO | 01/02170 | A1 | 1/2001 |
| WO | 01/02171 | A1 | 1/2001 |
| WO | 01/72518 | A1 | 10/2001 |

OTHER PUBLICATIONS

PCT Notification of Transmittal of Translation of the International Preliminary Report on Patentability (Chapter I or Chapter II of the Patent Cooperation Treaty) for PCT/EP2008/056512; dated Jan. 21, 2010; International Filing Date May 27, 2008.
International Search Report for WO 2008/151932 A3 / PCT/EP2008/056512.

* cited by examiner

*Primary Examiner* — Walter L Lindsay, Jr.
*Assistant Examiner* — Roy Y Yi
(74) *Attorney, Agent, or Firm* — Michael L. Dunn

(57) ABSTRACT

A printing machine having a colorant support, a transfer device, a delivery apparatus, and a colorant stripper. The transfer device is arranged to transfer colorant from a reservoir onto the colorant support such that during operation of the printing machine, a colorant is transferred from the transfer device onto the colorant support. The delivery apparatus is arranged to deliver at least part of the colorant from the colorant support onto a printing medium or a transfer means. The colorant support and the colorant stripper are arranged so that during operation of the printing machine, non-consumed colorant is transferred from the colorant support onto the colorant stripper. The invention is also a method for printing using such an apparatus.

20 Claims, 2 Drawing Sheets

PRINTING MACHINE AND PRINTING METHOD THEREFOR

CROSS REFERENCE TO RELATED APPLICATIONS

This is a nationalization of PCT/EP2008/056512 filed in Europe on May 27, 2008 in the German language which in turn claims priority from German Patent Application DE 10 2007 026883.3 filed Jun. 11, 2007, both of which are incorporated by reference herein in their entirety.

BACKGROUND OF THE INVENTION

The present invention relates to a printing machine with a colorant support and a transfer device to transfer colorant from a reservoir onto the colorant support, wherein the transfer device and the colorant support are arranged with respect to each other in such a manner that a first transfer zone is formed in which, during operation of the printing machine, a colorant is transferred from the transfer device onto the colorant support, and being provided with a delivery apparatus to deliver at least part of the colorant from the colorant support onto a printing medium or a transfer means.

Furthermore, the invention relates to a printing process with the following steps: transferring a colorant from a transfer device onto a colorant support, whereby at least portions of a continuous film of colorant are transferred onto the colorant support; delivering at least a portion of the colorant from the colorant support onto a printing medium or a transfer means.

WO-A1-01/72518, incorporated herein by reference as background art, discloses a printing process for the transfer of a colorant from a colorant support onto a printing medium or a transfer means, in which the colorant undergoes a volume and/or positional change brought about using a controlled energy-delivering device, thus transferring a printing dot onto the printing medium or the transfer means. Here, the colorant is placed on the colorant support in a manner than it forms an essentially continuous film. Localized energy is then applied to this film so that the film undergoes a localized change in volume or position, and the colorant in this region is transferred from the colorant support onto a printing medium or a transfer means.

Once the transfer action from the colorant support onto the printing medium has been completed, the homogeneity of the film of colorant on the colorant support has been compromised. There now exist regions in which the colorant has been at least partially removed form the colorant support, while in other regions the colorant still forms a film with its original thickness or original volume. If, for example, the colorant support is then replenished using the dipping roller principle using the same amount of colorant as before, then in the regions in which the colorant has been ablated, less colorant or colorant substance accumulates, while in regions in which no colorant has been ablated, a thicker layer of colorant is built up. In this manner, already by the second inking-up of the colorant support, the film of colorant which is produced is no longer homogeneous, but exhibits localized differences in volume and/or thickness.

Moreover, many of the print colorants in use contain relatively volatile solvents, and so regions of the colorant film which remain for a longer period on the colorant support without being ablated dry up. Thus, particularly in regions which are only infrequently ablated, the film of colorant may dry up and stick to the colorant support.

BRIEF SUMMARY OF THE INVENTION

Considering the above background, the present invention aims to provide a printing machine and a corresponding printing process which, even after several transfers of colorant from the colorant support to a printing medium or a transfer means, guarantees a homogeneous, continuous film on the colorant support.

This aim is achieved by dint of a printing machine provided with a colorant support and a transfer device to transfer colorant from a reservoir onto the colorant support, wherein the transfer device and the colorant support are arranged with respect to each other in such a manner that a first transfer zone is formed in which, during operation of the printing machine, a colorant is transferred from the transfer device onto the colorant support, and being provided with a delivery apparatus to deliver at least part of the colorant from the colorant support onto a printing medium or a transfer means, wherein it the machine is provided with a colorant stripper, whereby the colorant support and the colorant stripper are arranged so that a second transfer zone is formed in which, during operation of the printing machine, the unused colorant is transferred from the colorant support onto the colorant stripper.

DETAILED DESCRIPTION OF THE INVENTION

Figure 1:
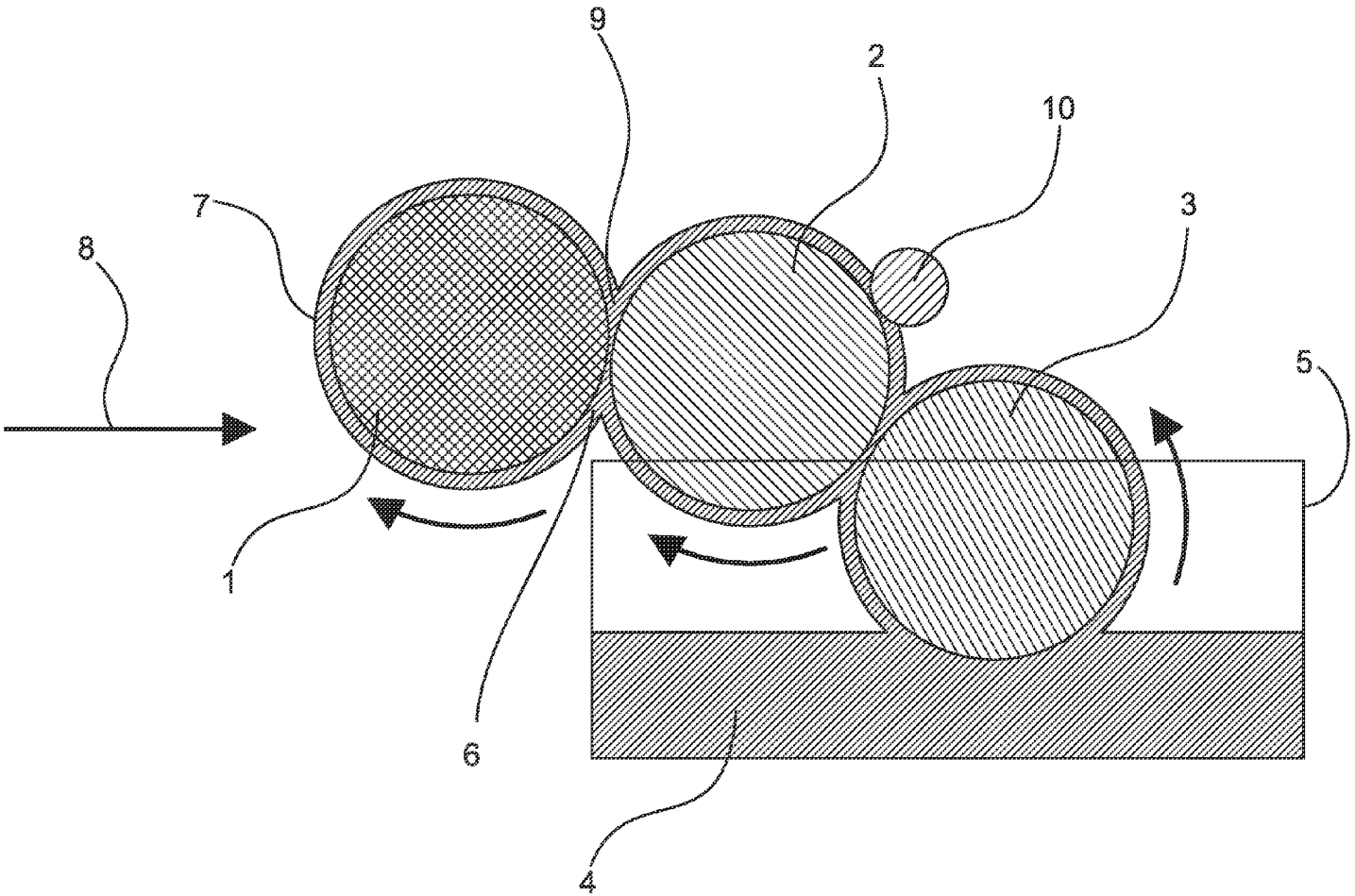
FIG. 1 shows a first embodiment of the printing machine of the invention.

The term "colorant" as used in the context of the present invention encompasses all kinds of printing mediums, including solid colorants. Particularly advantageously, liquid colorants, for example aniline dyes, are used. Preferably, colorants with a viscosity of less than 10000 mPas and particularly preferably with a viscosity of less than 1000 mPas are used.

A printing machine of this type allows the colorant support to be inked up, whereby the colorant is applied to the colorant support in a constant flow between a container or reservoir of the printing machine and the medium carrying the layer of colorant, which is termed the colorant support. Since in this manner the colorant on the colorant support is continuously being at least partially but preferably completely renewed depending on the printing action, build-up of colorant or even drying out of the colorant is almost entirely excluded.

Furthermore, in one embodiment of the printing machine, it is possible to change the thickness of the layer of colorant on the colorant support in a stepless manner; thus, the amount of colorant which is transferred can be adjusted.

Although it is possible to envisage embodiments in which the transfer device is a plate-like arrangement, in one embodiment of the invention the transfer device is a transfer roller which is particularly suitable for continuous operation of the printing machine. This is also the case for the colorant stripper, which is advantageously formed as a roller.

The colorant support which acts to transfer the colorant onto a printing medium or a transfer means is, in one embodiment of the invention, a roller which is rotatably mounted about an axis, or it is a continuous band which is fed over appropriate guides and/or rollers and which can move in a continuous path.

Printing of the object to be printed (also termed the printing medium) can be carried out either directly by transferring the colorant from the colorant support onto the printing medium, or indirectly by transferring the colorant from the colorant support onto a transfer means (for example a rubber sheet) and then from that onto the printing medium.

In one embodiment of the present invention, when printing a printing medium or a transfer means with a printing machine, a colorant support is initially inked up with the colorant, i.e. a film of colorant is applied to the colorant support which at least partially but advantageously completely coats the colorant support.

In one embodiment of the invention, this produces an essentially coherent continuous film of colorant on the colorant support.

In one embodiment, to allow continuous application of the film of colorant onto the colorant support, the transfer device of the printing machine is provided with a transfer roller which is arranged with respect to the colorant support in a manner such that a transfer zone is formed in which the colorant guided by the transfer device is transferred from the transfer device onto the colorant. In one embodiment of the invention, said transfer is achieved by rotating the transfer device, which is formed as a roller, and a colorant support, also formed as a roller, about their respective rotational axes.

In the next step, the colorant applied as a film to the colorant support, i.e. the colorant, is delivered from the colorant support to a printing medium or a transfer means.

In one embodiment, local, i.e. spot energy, is supplied to the colorant. This supply of energy heats the colorant locally so that subsequently, there is a local change in the volume and/or position of the colorant on the colorant support, and the colorant, in the form of a printing dot, moves in the direction of the object to be printed (printing medium or transfer means) and is taken up by the object to be printed.

There are a number of ways of directing spots of energy into the colorant. In one embodiment, the delivery device is provided with a device for the production of a beam of energy which is provided for the localized application of energy to the colorant on the colorant support, so that during operation of the machine, at least a portion of the colorant is delivered to a printing medium or a transfer means from the colorant support. The beam of energy may be an electromagnetic wave, for example from a laser, or a beam of massive particles, for example an electron or ion beam.

In one embodiment of the invention, the application of energy to the colorant may be direct, i.e. by absorption or uptake of the beam of energy into the colorant itself. Thus, the beam of energy is directed onto the colorant on the colorant support. This can be carried out both from outside and inside, if it is possible to use a hollow cylindrical colorant support which is essentially transparent to the energy beam, i.e. the beam passes through the colorant support.

In an alternative embodiment of the invention, the energy is applied to the colorant indirectly, whereupon the beam of energy is absorbed or taken up by the colorant support itself and the energy is transferred from the colorant support to the colorant by heat conduction, for example.

After ablation or transfer of the colorant from the colorant support to the printing medium or the transfer means, regions remain in the film of colorant on the colorant support from which colorant has been removed and in which, therefore, the thickness of the colorant film is greatly reduced or the colorant has been completely removed.

However, in order for the printing action to ensure homogeneous conditions for the colorant after the next turn of the colorant support, in accordance with the invention, a colorant stripper is arranged in the direction of the process which is downstream of the energy application location. In one embodiment of the invention, this is arranged such that a second transfer zone is formed in which, during operation of the printing machine, the unused colorant is transferred from the colorant support onto the colorant stripper. In this manner, after partial ablation of colorant, the colorant support is cleaned, i.e. at least part of the colorant remaining on the colorant support is at least partially removed before fresh colorant is applied to the colorant support by the transfer device.

WO 01/72518, mentioned in the introduction, also discloses a colorant stripper which is provided to clean a transfer means. However, this colorant stripper only cleans one transfer means, i.e. the intermediate between the colorant support and the printing medium, of colorant residues which, because they come into contact with the printing medium, are contaminated and thus are not suitable for returning to the colorant reservoir. Further, the colorant stripper in WO 01/72518 does not clean the colorant support.

In a further embodiment of the present invention, the transfer device for inking up the colorant support is a system for contact-free application of colorant onto the colorant support, such as a dip, spray or wash system, an electrostatically controlled coating system, a vapour or sublimation transfer system or a similar system for application of colorant.

In one embodiment of the invention, the transfer device, the colorant stripper and the colorant support have colorant supporting surfaces and move in such a manner that their colorant supporting surfaces have opposite directions of motion in the transfer zones. This allows even application and removal of colorant onto and off the colorant support.

In a further embodiment of the invention, the colorant stripper and the transfer device are identical to each other. In one embodiment, they are advantageously formed by one and the same roller. Thus, advantageously, the first and second transfer zones are arranged immediately adjacent to each other.

This means that inking up, i.e. transferring colorant onto the colorant support, and cleaning, i.e. transferring colorant from the colorant support, can be carried out using one and the same apparatus.

In this respect, in an advantageous embodiment, the roller which simultaneously forms the transfer device and the colorant stripper and the roller of the colorant support are rotatable in the same direction of rotation. In this manner, in the transfer zone in which on the one hand colorant is transferred from the transfer roller onto the colorant support and on the other hand the colorant support is freed from the colorant remaining following printing, the colorant supporting surfaces of the transfer roller and colorant support move in opposite directions.

If the transfer device and the colorant stripper are formed as a single roller, wherein in operation the roller of the transfer device or the colorant stripper and the colorant support have the same rotational direction, then advantageously, the roller of the transfer device and the colorant support are at a distance from each other such that their colorant supporting surfaces, at the location where they are closest to each other, do not quite come into contact. Thus, the first and second transfer zones are formed in the immediate environment of the location with the shortest distance between the colorant supporting surfaces, avoiding hindrance of the rotational motion of the rollers by contact interference.

Changing the distance between the transfer device and the colorant support on the one hand and the colorant support and the colorant stripper on the other hand allows the thickness of the colorant film on the colorant support to be adjusted.

Furthermore, the thickness of the colorant film can be adjusted by changing the relative velocities of the colorant supporting surfaces of the transfer device, colorant stripper and colorant support.

In one embodiment of the invention, the printing machine has a reservoir for the colorant and a dipping roller, the dipping roller being arranged so that during operation of the machine, colorant is removed from the reservoir. In one embodiment, the dipping roller can thus be identical with the transfer device. In an alternative embodiment, however, the transfer device and the dipping roller consist of separate elements, wherein the dipping roller removes colorant from the reservoir and transfers it to the transfer device.

In one embodiment of the invention, the transfer device is produced from rubber.

During operation of the printing machine of the invention, with the aid of the colorant stripper after carrying out a printing action, the colorant support is freed of colorant remaining on the colorant support so that the transfer device carries on its colorant supporting surface the colorant remaining on the colorant support after the printing action. To remove this from the transfer device, in one embodiment the printing machine of the invention has a colorant stripping device which is arranged so that during operation of the printing machine, unused colorant is removed from the transfer device. In this regard, the colorant stripping device is linked to a reservoir for the colorant, so that the unused colorant is returned to the reservoir. In this manner, a closed circuit can be produced for that part of the colorant which, during a printing action, is not passed from the colorant support to the printing medium or the transfer means.

The aim of the invention is also accomplished by dint of a printing process with the following steps: transferring a colorant from a transfer device onto a colorant support, whereby at least part of a coherent film of the colorant is applied to the colorant support; applying at least a portion of the colorant from the colorant support onto a printing medium or a transfer means, wherein the portion of the colorant which is not delivered from the colorant support is stripped from the colorant support.

Further advantages, features and applications of the present invention will now be illustrated with the aid of the following description of a preferred embodiment made with reference to the accompanying drawings.

FIG. 1 shows a diagrammatic sectional side view of a first embodiment of the printing machine of the invention. The printer shown has a roller printer with a roller colorant support 1, a rubber roller 2 as the transfer device and an additional dipping roller 3.

The individual elements of the printer will now be defined by describing the printing action. The path of the colorant or print colorant 4 will be traced from a reservoir 5 to the printing medium (not shown).

The dipping roller 3 takes up the print colorant 4 which, in the embodiment shown, is an aniline dye, from a reservoir 5 and transfers it to a rubber roller 2. For this transfer of the colorant 4 from the dipping roller 3 to the rubber roller 2, the dipping roller 3 and rubber roller 3 come into contact, whereby the two rollers 2, 3 move in opposite directions so that their surfaces, where they come into contact, are moving towards each other. In the embodiment shown, the dipping roller 3 is a screen roller.

The rubber roller 2 is immediately adjacent to the colorant support 1 to allow colorant 4 to be transferred from the rubber roller 2 onto the colorant support 1 and vice versa, from the colorant support 1 to the rubber roller 2. During operation of the printing machine, the rubber roller 2 and the colorant support 1 move in the same direction of rotation about their rotational axes, so that in the region at which they are closest, the colorant supporting surfaces move in mutually opposing directions. During rotation of rollers 1, 2, in a first transfer zone 6, i.e. below the point with the shortest distance between the colorant supporting surfaces of rollers 1, 2, colorant is transferred from the rubber roller 2 onto the colorant support 1 in the form of a thin film of colorant 7.

In order to apply the colorant film 7 from the colorant support 1 in the form of printing dots onto the printing medium fed past the colorant support 1, the colorant support 1 is locally illuminated using a laser beam 8. The laser beam 8 is focused and can be focused using an appropriate deflector (not shown) onto any point along a line which runs essentially parallel to the rotational axis of the colorant support. The laser beam 8 can be switched on or off as desired on moving along a line for each printing dot. Thus, in a line, any arrangement of printing dots can be transferred from the colorant support 1 onto a printing medium.

In the illustrated embodiment, the colorant 4 does not absorb at the wavelength of the laser light 8, so the colorant film 7 on the colorant support 1 is transparent to the laser light. Thus, this laser light arrives essentially unattenuated at the surface of the colorant support 1, which carries an absorption layer which is particularly adapted to the wavelength of the laser light 8. The absorption layer absorbs at least a portion of the energy from the laser beam 8 locally in the region of the focal point of the laser beam 8 and delivers this to the film 7 of colorant 4 on the colorant support 1 in the form of heat. The abrupt local heating of the colorant film 7 expands the part of the colorant film which is indirectly heated by the laser beam 8, whereupon it comes into contact with the printing medium which is being fed past the colorant support 1 at a minimum distance therefrom, adheres thereto and is thus transferred thereto.

In the direction of rotation of the colorant roller 1 behind the point of impact or focal point of the laser beam 8, the colorant film 7 on the colorant support 1 exhibits regions in which the colorant film 7 is unchanged and other regions in which the colorant has been transferred as dots from the colorant film 7 onto the printing medium. Thus, the colorant film 7 has an inhomogeneous layer thickness in the direction of rotation behind the focal point of the laser beam 8.

In order once again to produce a homogeneous layer thickness of the colorant film 7 on the colorant support on a complete rotation of the colorant support 1, in a second transfer zone 9, i.e. above the point with the shortest distance between the colorant supporting surfaces of the rubber roller 2 and the colorant support 1, the remaining colorant film 7 is transferred to the rubber carrier 2.

In the first transfer zone 6, a fresh colorant film 7 is applied to the colorant support 1, which as before has a homogeneous thickness and can be ablated by the laser beam 8. The colorant which is transferred back from the colorant support 1 to the rubber roller 2 is removed from the rubber roller 2 with the aid of a colorant stripping device 10 formed as a squeegee and fed back to the reservoir 5 using an appropriate connection. This forms a closed circuit for the colorant 4 from the reservoir 5 via the dipping roller 3, the rubber roller 2 onto the colorant support 1 and back from the colorant support 1 via the rubber roller 2 and the squeegee 10 into the reservoir 5.

Figure 2:
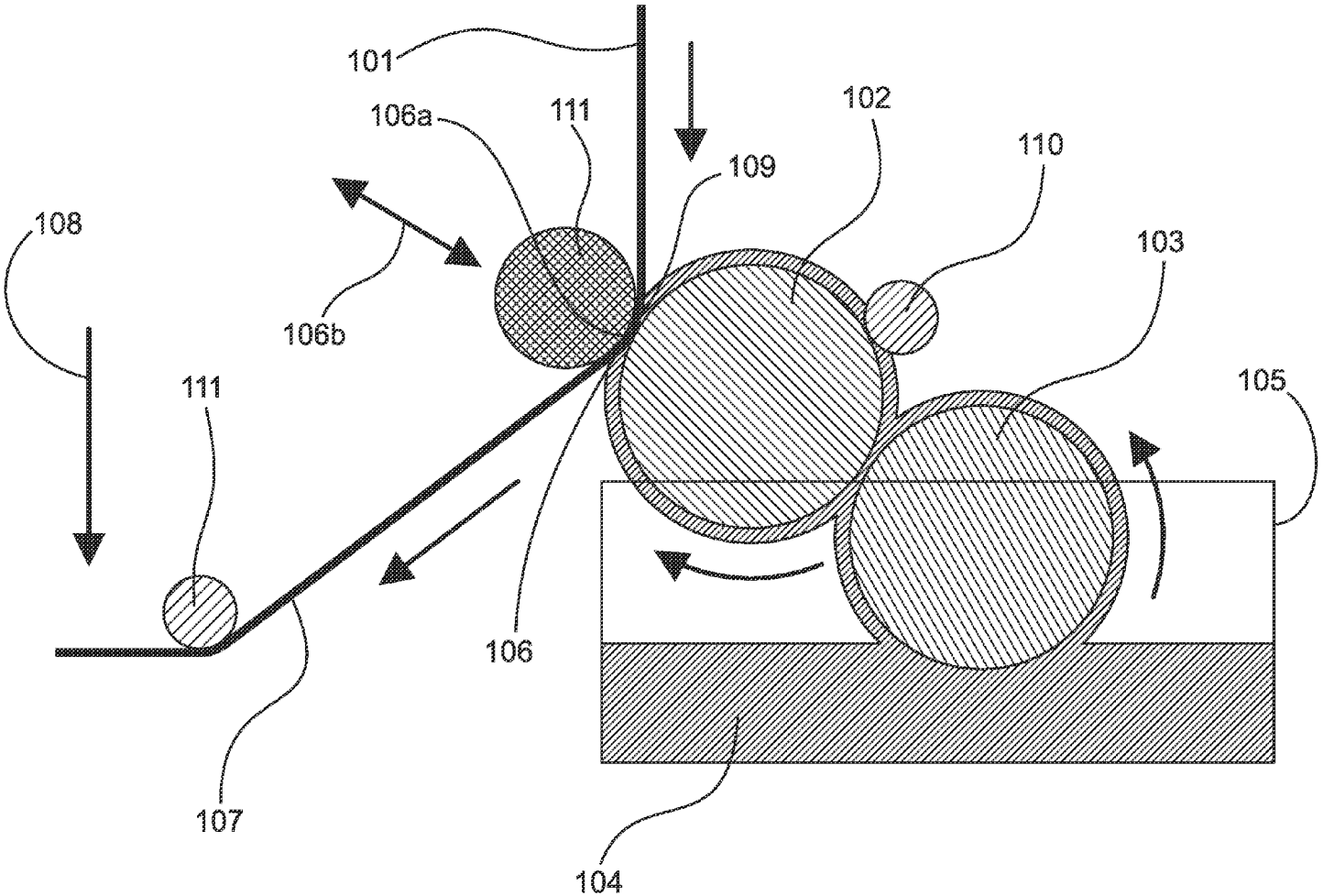
FIG. 2 shows a further embodiment of the printing machine of the invention.

FIG. 2 shows an alternative embodiment of the printing machine of the invention, which differs from the embodiment of FIG. 1 in that the roller type colorant support 1 has been replaced by a continuous band 101. As was the case with the embodiment of FIG. 1, the colorant 104 is transported from the reservoir 105 using a dipping roller 103 onto a rubber roller 102 and from there onto the continuous band 101 which acts as the colorant support. Transfer of the colorant 104 from the rubber roller 102 onto the continuous band 101 occurs in the first transfer zone 106, i.e. the zone below the point with the shortest distance between the colorant supporting surfaces of the rubber roller 102 and the continuous band 101. In the first transfer zone 106, colorant 104 is applied to the continuous band 101 as a thin continuous film 107. The continuous band 101 is guided using guide rollers 111 so that on the one hand it is fed past the rubber roller 102 immediately adjacent thereto, and on the other hand so that it a laser beam 108 can impinge upon it.

In the embodiment shown, the continuous band 101 is transparent to the wavelength of the laser beam 108 so that the laser beam passes unattenuated through the continuous band 101 until it meets the colorant film 107 arranged on the other surface of the continuous band 101. In the embodiment shown in FIG. 2, the colorant 104 and thus the colorant film 107 absorbs at the wavelength of the laser beam 108 so that the energy of the laser beam 108 is absorbed directly by the colorant film 107 and the resulting localized heating of the colorant film 107 changes the volume and/or position of the section of the colorant film 107 lying in the focal point of the laser beam 108. The positional change means that the printing dot is transferred onto the printing medium (not shown) which passes close by the continuous band 101.

In the direction of motion of the continuous band which is downstream of the laser beam 108, the partially ablated colorant film 107 is fed further on the continuous band 101 until it is transferred in the second transfer zone 109, i.e. above the point with the shortest distance between the colorant supporting surfaces of the continuous band 101 and the rubber roller 102, from the colorant support 101 onto the rubber roller 102, whereupon the continuous band 101 is almost completely freed of print colorant 104 before the next cycle. The colorant which is returned to the rubber roller 102 is removed from the rubber roller 102 using a squeegee 110 and fed from the squeegee 110 to the reservoir 105 by means of an appropriate connection.

Thus, the embodiment shown in FIG. 2 forms a closed circuit for the colorant 104 from the reservoir 105 via the dipping roller 103 and the rubber roller 102 onto the colorant support 101 and back from the colorant support 101 via the rubber roller 102 and the squeegee 110 to the reservoir 105.

The essential point is that in the alternative embodiment shown in FIG. 2, the colorant support 101 and the rubber roller 102 are driven at their contact points 106, 109 in such a manner that the colorant supporting surfaces move in opposite directions to each other.

Thus, both the distance 106*a* between the colorant supporting surfaces of the colorant support 1, 101 and the transfer devices 2, 102 as well as their relative velocities in the first 6, 106 and second 9, 109 transfer zones are adjusted as shown by arrow 106*b* so that a sufficient thickness of colorant film which is appropriate for the printing medium being used is produced on the colorant support.

For the purposes of original disclosure, it should be noted that any features of which a skilled person becomes aware from the present description, drawings and claims, even if they are only specifically described in connection with particular further features, can be combined both individually and in any combinations with other features or combinations of features disclosed herein, insofar as this is not expressly excluded or such combinations are impossible or of no purpose for technical reasons. A comprehensive explicit description of all envisageable combinations of features has not been given here purely for the purposes of legibility of the description.

LIST OF ITEM NUMBERS IN THE DRAWINGS AND DESCRIPTION OF PREFERRED EMBODIMENTS

1 Colorant support
2 Rubber roller
3 Dipping roller
4 Print colorant
5 Reservoir
6 First transfer zone
7 Thin colorant film
8 Laser beam
9 Second transfer zone
10 Colorant stripping device
101 Continuous band
102 Rubber roller
103 Dipping roller
104 Print colorant
105 Reservoir
106 First transfer zone
107 Colorant film
108 Laser beam
109 Second transfer zone
110 Squeegee
111 Guide roller

What is claimed is:

1. A printing machine having a colorant support, a transfer device, a delivery apparatus, and a colorant stripper; said transfer device being arranged to transfer colorant from a reservoir onto the colorant support, wherein the transfer device and the colorant support are arranged with respect to each other in such a manner that a first transfer zone is formed in which, during operation of the printing machine, a colorant is transferred from the transfer device onto the colorant support, and the delivery apparatus being provided to deliver at least part of the colorant from the colorant support onto a printing medium or a transfer means, wherein the delivery device is provided with a device for the production of a beam of energy for localized application of energy to the colorant on the colorant support so that during operation of the machine, at least a portion of the colorant is delivered to a printing medium or a transfer means from the colorant support, wherein the colorant support and the colorant stripper are arranged so that a second transfer zone is formed in which, during operation of the printing machine, non-consumed colorant is transferred from the colorant support onto the colorant stripper.

2. A printing machine according to claim 1, wherein the device for producing a beam of energy is a laser.

3. A printing machine according to claim 1 wherein the transfer device, the colorant stripper and the colorant support are provided with colorant supporting surfaces and are movable such that their colorant supporting surfaces move in opposite directions in the transfer zones.

4. A printing machine according to claim 1 wherein the colorant stripper and the transfer device are identical.

5. A printing machine according to claim 1 wherein the first and the second transfer zones are arranged immediately adjacent to each other.

6. A printing machine according to claim 1 wherein the colorant support is a roller or a continuous band.

7. A printing machine according to claim 1 wherein it is provided with a reservoir for colorant and a dipping roller, wherein the dipping roller is arranged so that, during operation of the machine, colorant is removed from the reservoir and applied to the transfer device.

8. A printing machine according to claim 1 wherein the colorant stripping device is arranged such that, during operation of the printing machine, non-consumed colorant is removed from the transfer device and is linked to a reservoir for the colorant so that the non-consumed colorant is guided back to the reservoir.

9. A printing process comprising the steps of:

transferring a colorant from a transfer device onto a colorant support such that at least part of a coherent film of the colorant is applied to the colorant support;

applying at least a portion of the colorant from the colorant support onto a printing medium or a transfer means by locally applying energy to the colorant on the colorant support so that at least a part of the colorant undergoes a change in volume or position and is delivered from the colorant support onto a printing medium or transfer means wherein a remaining portion of the colorant which is not delivered from the colorant support is stripped from the colorant support.

10. A printing process according to claim 9, wherein the energy is applied directly or indirectly to the colorant using a laser beam.

11. A process according to claim 9 wherein colorant is delivered onto a printing medium and transfer and removal of printing medium to or from the colorant support are carried out at immediately adjacent locations.

12. A process according to claim 9 wherein the transfer device and the colorant support are provided with colorant supporting surfaces, wherein the surfaces of the transfer device and the colorant support move in opposite directions in a zone in which the colorant is transferred.

13. A process according to claim 9 wherein the colorant is transferred onto a colorant stripper from the colorant support for removal, wherein the colorant support and the colorant stripper are provided with colorant supporting surfaces, wherein the colorant supporting surfaces of the colorant support and the colorant stripper move in opposite directions in a zone in which the colorant is transferred.

14. A process according to claim 9 wherein the colorant is removed from a reservoir and applied to the transfer device.

15. A process according to claim 14 wherein the colorant is removed from a reservoir and applied to the transfer device using a dipping roller.

16. A process according to claim 15 wherein colorant which is not delivered is returned to a reservoir.

17. A process according to 9 wherein the colorant support is coated with an essentially homogeneous thickness of a film of colorant.

18. A process according to claim 13 wherein a velocity between colorant supporting surfaces of the transfer device and the colorant support and/or the colorant support and the colorant stripper are varied in order to adjust the thickness of the film of colorant.

19. A process according to claim 13 wherein distances between the colorant supporting surfaces of the transfer device and the colorant support and/or the colorant support and the colorant stripper are varied in order to adjust the thickness of the film of colorant.

20. A process according to claim 9 wherein the colorant employed is a colorant with a viscosity of less than 10000 mPas.

* * * * *